US010962919B2

(12) United States Patent
Kataoka et al.

(10) Patent No.: US 10,962,919 B2
(45) Date of Patent: Mar. 30, 2021

(54) IMAGE FORMING APPARATUS

(71) Applicant: Konica Minolta Inc., Tokyo (JP)

(72) Inventors: Naoki Kataoka, Toyokawa (JP); Tetsuya Onuki, Toyokawa (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 16/940,958

(22) Filed: Jul. 28, 2020

(65) Prior Publication Data

US 2021/0063947 A1 Mar. 4, 2021

(30) Foreign Application Priority Data

Aug. 28, 2019 (JP) ..... JP2019-155934

(51) Int. Cl.
*G03G 21/16* (2006.01)

(52) U.S. Cl.
CPC ..... *G03G 21/1633* (2013.01); *G03G 21/1647* (2013.01); *G03G 2221/163* (2013.01); *G03G 2221/1684* (2013.01)

(58) Field of Classification Search
CPC ..... G03G 21/1623; G03G 21/1628; G03G 21/1633; G03G 21/1647
See application file for complete search history.

(56) References Cited

U.S. PATENT DOCUMENTS

2003/0118367 A1* 6/2003 Omata ..... G03G 21/1647 399/110
2009/0290903 A1* 11/2009 Horikawa ..... G03G 21/185 399/111
2011/0299873 A1* 12/2011 Ushiozu ..... G03G 21/1647 399/90
2011/0305479 A1* 12/2011 Nishiuwatoko .... G03G 21/1623 399/110
2012/0155916 A1* 6/2012 Ito ..... B41J 29/13 399/110
2014/0248066 A1* 9/2014 Akiyama ..... E05D 3/12 399/107

FOREIGN PATENT DOCUMENTS

JP 2015-18122 A 1/2015

* cited by examiner

*Primary Examiner* — Carla J Therrien
(74) *Attorney, Agent, or Firm* — Rankin, Hill & Clark LLP

(57) ABSTRACT

An image forming apparatus includes: a cover member that covers part of a main body frame; a first turn support member having: one end turnably supported by a first shaft provided at the main body frame, the first shaft extending horizontally; and another end turnably supported by a second shaft provided at the cover member, the second shaft extending horizontally; and a second turn support member having: one end turnably supported by a third shaft provided below the first shaft of the main body frame, the third shaft extending horizontally; and another end turnably supported by a fourth shaft provided at the cover member, the fourth shaft extending horizontally, wherein in a closed state where the cover member covers the main body frame, the fourth shaft is located below the third shaft, and in a fully open state, the fourth shaft is located above the third shaft.

7 Claims, 10 Drawing Sheets

IMAGE FORMING APPARATUS

The entire disclosure of Japanese patent Application No. 2019-155934, filed on Aug. 28, 2019, is incorporated herein by reference in its entirety.

BACKGROUND

Technological Field

The present invention relates to an image forming apparatus, and particularly to an image forming apparatus that forms an image with toner.

Description of the Related Art

An image forming apparatus represented by a multi function peripheral (MFP) has built-in parts such as consumables that need replacement. Thus, the MFP has a main body case provided with a cover member. Opening of the cover member allows the user to replace a part built in the main body case. In order to secure a space for attaching the part to and detaching the part from the main body case, there is need to secure a space that allows movement of the cover member.

On the other hand, due to the limitation of the external shape of the MFP, it is desirable to minimize a gap and a step between the cover member and the main body case so that the cover member is unnoticeable in a closed state thereof. Therefore, in order to secure the space that allows the movement of the cover member and avoid interference with other parts, the cover member needs to be provided so as to open while the cover member moves away from the main body case.

For example, JP 2015-18122 A discloses a cover opening/closing mechanism having a first hinge member and a second hinge member. The first hinge member is pivotably supported about a first hinge pivoting fulcrum A1 of a copying machine main body, and supports an opening/closing cover such that the opening/closing cover is turnable about a first cover pivoting fulcrum B1 of the opening/closing cover to the first hinge member. The second hinge member is pivotably supported about a second hinge pivoting fulcrum A2 of the copying machine main body, and supports the opening/closing cover such that the opening/closing cover is turnable about a second cover pivoting fulcrum B2 of the opening/closing cover to the second hinge member. The cover opening/closing mechanism is provided such that the relative positional relationship between the cover pivoting fulcrum B1 and the cover pivoting fulcrum B2 varies working with an operation that causes the opening/closing cover to switch from a closed state to an open state and each hinge member pivots in a direction in which the cover pivoting fulcrum B1 and the cover pivoting fulcrum B2 are spaced apart from the copying machine main body.

However, for the cover opening/closing mechanism disclosed in JP 2015-18122 A, each hinge member pivots in the direction where the cover pivoting fulcrum B1 and the cover pivoting fulcrum B2 are spaced apart from the copying machine main body. Thus, a gap is generated between the opening/closing cover and the copying machine main body.

Examples of consumables built in a multi function peripheral (MFP) include a toner bottle that contains toner. In operation of replacing the toner bottle, toner may adhere to, a toner discharge port of the toner bottle or the like, and the toner may drop due to, for example, vibration of the toner bottle during the replacement. At this time, if a cover member is located below the toner bottle, the cover member receives the toner, and thus the floor is not soiled with the toner. However, a presence of a gap between the main body case and the cover member may raise a disadvantage such as a case where the toner passes through the gap and drops onto the floor.

SUMMARY

An object of the present invention is to provide an image forming apparatus having no gap provided between a cover member and a main body frame in an open state of the cover member.

To achieve the abovementioned object, according to an aspect of the present invention, an image forming apparatus reflecting one aspect of the present invention comprises: a cover member that covers part of a main body frame; a first turn support member having: one end turnably supported by a first shaft provided at the main body frame, the first shaft extending horizontally; and another end turnably supported by a second shaft provided at the cover member, the second shaft extending horizontally; and a second turn support member having: one end turnably supported by a third shaft provided below the first shaft of the main body frame, the third shaft extending horizontally; and another end turnably supported by a fourth shaft provided at the cover member, the fourth shaft extending horizontally, wherein in a closed state where the cover member covers the main body frame, the fourth shaft is located below the third shaft, and in a fully open state of the cover member, the fourth shaft is located above the third shaft.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings.

However, the scope of the invention is not limited to the disclosed embodiments. In the following description, the same parts are denoted with the same reference signs. Those names and functions are also the same. Therefore, detailed description thereof will not be repeated.

Figure 1:
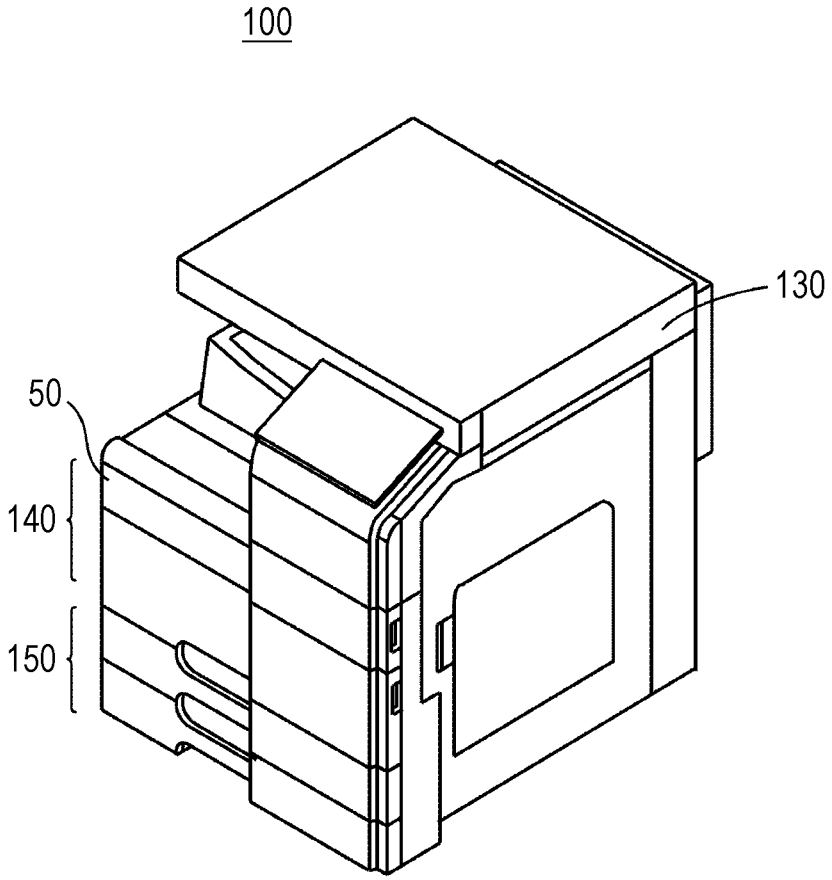
FIG. 1 is a first perspective view illustrating an external appearance of a multi function peripheral (MFP) according to an embodiment of the present invention.
Figure 2:
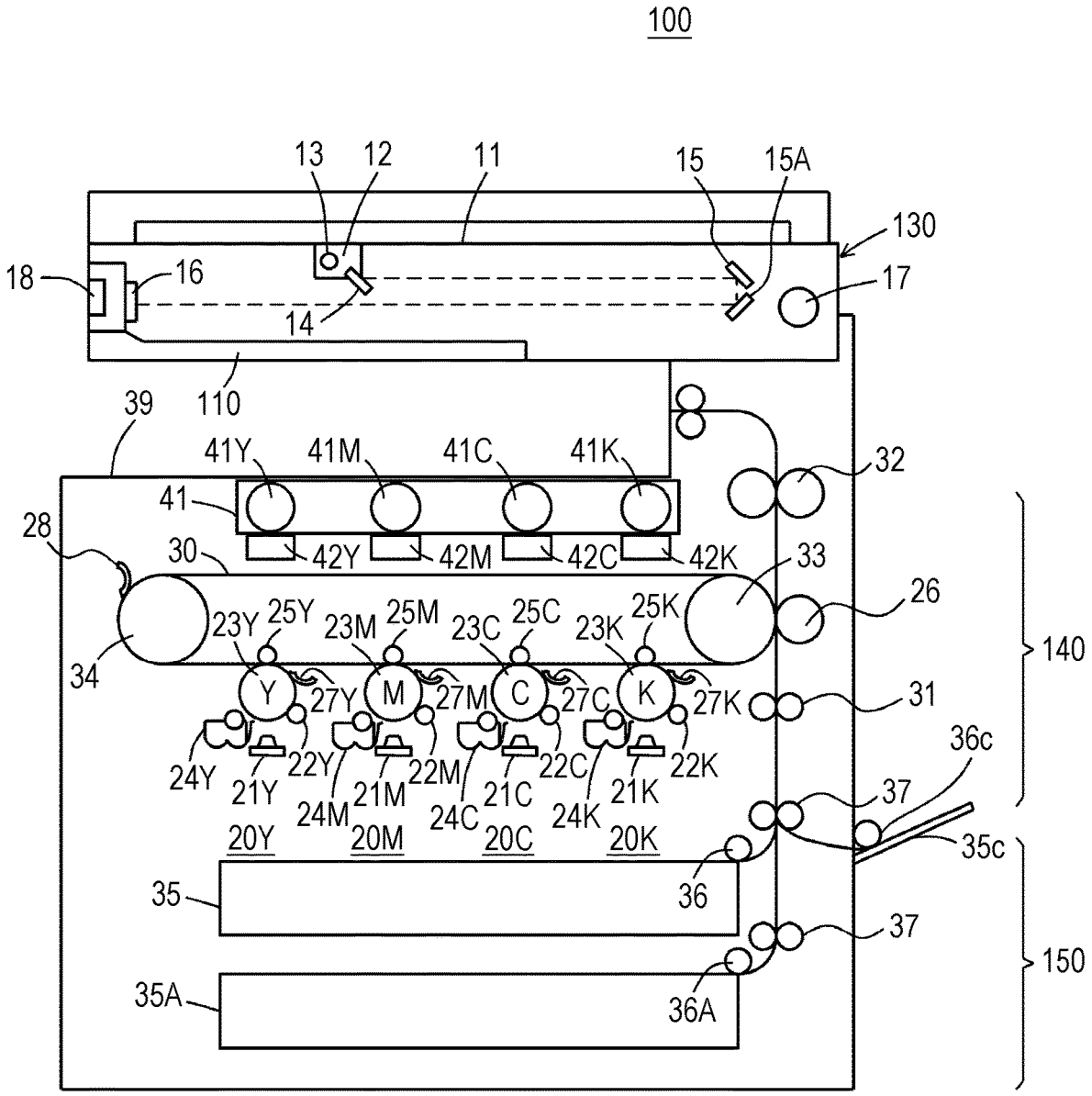
FIG. 2 is a cross-sectional view schematically illustrating an exemplary internal configuration of the MFP.

FIG. 1 is a first perspective view illustrating an external appearance of a multi function peripheral (MFP) according to the embodiment of the present invention. FIG. 2 is a cross-sectional view schematically illustrating an exemplary internal configuration of the MFP. Hereinafter, for the sake of explanation, the left and right in direction in FIG. 2 is referred to as the left-and-right direction, and the front and back in direction is referred to as the depth direction. In the left-and-right direction, the direction from left to right is referred to as the right side-face direction, and the direction from right to left is referred to as the left side-face direction. In the depth direction, the direction from front to back is referred to as the front face direction, and the direction from back to front is referred to as the rear face direction. Referring to FIGS. 1 and 2, an MFP 100 is an example of an image forming apparatus, and includes: a document reader 130 that reads a document; an image former 140 that forms an image on a sheet on the basis of image data; and a sheet feeder 150 that supplies a sheet to the image former 140.

The document reader 130 exposes an image of a document that has been set on a document glass 11 with an exposure lamp 13 attached to a slider 12 that moves under the document glass 11. The reflected light from the document is guided to a lens 16 by a mirror 14 and two reflecting mirrors 15 and 15A, and then forms an image on a charge coupled device (CCD) sensor 18.

The reflected light having formed the image on the CCD sensor 18 is converted into image data as an electric signal in the CCD sensor 18. The image data is converted into pieces of print data in cyan (C), magenta (M), yellow (Y), and black (K), and the pieces of print data are output to the image former 140.

The image former 140 includes image forming units 20Y, 20M, 20C, and 20K for respective yellow, magenta, cyan, and black. Here, "Y", "M", "C", and "K" represent yellow, magenta, cyan, and black, respectively. At least one of the image forming units 20Y, 20M, 20C, and 20K is driven, so that an image is formed. In a case where all the image forming units 20Y, 20M, 20C, and 20K are driven, a full-color image is formed. The pieces of print data in yellow, magenta, cyan, and black are input to the respective image forming units 20Y, 20M, 20C, and 20K. The image forming units 20Y, 20M, 20C, and 20K are simply different in dedicated toner color, and thus the image forming unit 20Y for forming a yellow image will be described here.

The image forming unit 20Y includes: an exposure device 21Y to which print data in yellow is input; a photoconductor drum 23Y serving as an image carrier; a charging roller 22Y for uniformly charging the front face of the photoconductor drum 23Y; a developing device 24Y; a primary transfer roller 25Y for transferring, due to the action of electric force, a toner image formed on the photoconductor drum 23Y onto an intermediate transfer belt 30 serving as an image carrier; a drum cleaning blade 27Y for removing transfer residual toner on the photoconductor drum 23Y; a toner bottle 41Y; and a toner hopper 42Y.

The toner bottle 41Y contains yellow toner. The toner bottle 41Y is turned by a toner bottle motor as a drive source and externally discharges the toner. The toner discharged from the toner bottle 41Y is supplied to the toner hopper 42Y. The toner hopper 42Y supplies the toner to the developing device 24Y in accordance with the timing at which the remaining amount of toner contained in the developing device 24Y is equal to or lower than a predetermined lower limit value.

On the periphery of the photoconductor drum 23Y, the charging roller 22Y, the exposure device 21Y, the developing device 24Y, the primary transfer roller 25Y, and the drum cleaning blade 27Y are disposed in this order along the rotation direction of the photoconductor drum 23Y.

The photoconductor drum 23Y is charged by the charging roller 22Y, and then irradiated with laser light emitted from the exposure device 21Y. The exposure device 21Y exposes a portion corresponding to an image on the front face of the photoconductor drum 23Y, and then forms an electrostatic latent image. As a result, the electrostatic latent image is formed on the photoconductor drum 23Y. Subsequently, the developing device 24Y develops the electrostatic latent image formed on the photoconductor drum 23Y, with charged toner. Specifically, due to the action of electric force, toner is placed on the electrostatic latent image formed on the photoconductor drum 23Y, so that a toner image is formed on the photoconductor drum 23Y. Due to the action of electric force, the primary transfer roller 25Y transfers the toner image formed on the photoconductor drum 23Y onto the intermediate transfer belt 30 serving as the image carrier. Toner residual on the photoconductor drum 23Y without being transferred is removed from the photoconductor drum 23Y by the drum cleaning blade 27Y.

Meanwhile, the intermediate transfer belt 30 is stretched around a drive roller 33 and a driven roller 34 such that the intermediate transfer belt 30 does not loosen. When the drive roller 33 rotates counterclockwise in FIG. 2, the intermediate transfer belt 30 rotates counterclockwise in the figure at a predetermined speed. The driven roller 34 rotates counterclockwise as the intermediate transfer belt 30 rotates.

This arrangement causes the image forming units 20Y, 20M, 20C, and 20K to sequentially transfer the respective toner images onto the intermediate transfer belt 30. The timing at which the image forming units 20Y, 20M, 20C, and 20K transfer the respective toner images onto the intermediate transfer belt 30 is adjusted by detection of a reference mark given to the intermediate transfer belt 30. As a result, the respective toner images in yellow, magenta, cyan, and black are superimposed on the intermediate transfer belt 30.

Due to the action of electric force, a secondary transfer roller 26 serving as a transfer member transfers, onto a sheet, the toner image formed on the intermediate transfer belt 30. The sheet that has been conveyed by a pair of timing rollers 31 is conveyed to the nip where the intermediate transfer belt 30 and the secondary transfer roller 26 are in contact with each other. The sheet on which the toner image is transferred is conveyed to a pair of fixing rollers 32, and then is heated and pressed by the pair of fixing rollers 32. As a result, the toner is melted and fixed on the sheet. Thereafter, the sheet is discharged to a sheet discharge tray 39.

A belt cleaning blade 28 is provided upstream the image forming unit 20Y side of the intermediate transfer belt 30. The belt cleaning blade 28 removes toner residual on the intermediate transfer belt 30 without being transferred onto the sheet.

Sheets different in size are set in sheet feeding cassettes 35 and 35A. Each sheet accommodated in the sheet feeding cassette 35 is supplied to a conveyance path by a take-out roller 36 attached to the sheet feeding cassette 35, and then sent to the pair of timing rollers 31 by a pair of sheet feeding rollers 37. Each sheet accommodated in the sheet feeding cassette 35A is supplied to the conveyance path by a take-out roller 36A attached to the sheet feeding cassette 35A, and then sent to the pair of timing rollers 31 by a pair of sheet feeding rollers 37.

In a case where the MFP 100 forms a full-color image, the MFP 100 drives all the image forming units 20Y, 20M, 20C, and 20K. On the other hand, in a case where the MFP 100 forms a monochrome image, the MFP 100 drives any one of the image forming units 20Y, 20M, 20C, and 20K. Further, the MFP 100 can also form an image by combination of at least two of the image forming units 20Y, 20M, 20C, and 20K. Note that, here, described is an example in which a tandem system is adopted for the MFP 100, the MFP 100 including the image forming units 20Y, 20M, 20C, and 20K that form respective toner images in four colors on a sheet. However, a four-cycle system may be adopted for an MFP 100, the MFP 100 including one photoconductor drum that sequentially transfers respective toner images in four colors onto a sheet.

The MFP 100 according to the present embodiment includes the toner bottle 41Y and toner bottles 41M, 41C, and 41K stored in a toner storage part 41.

Figure 3:
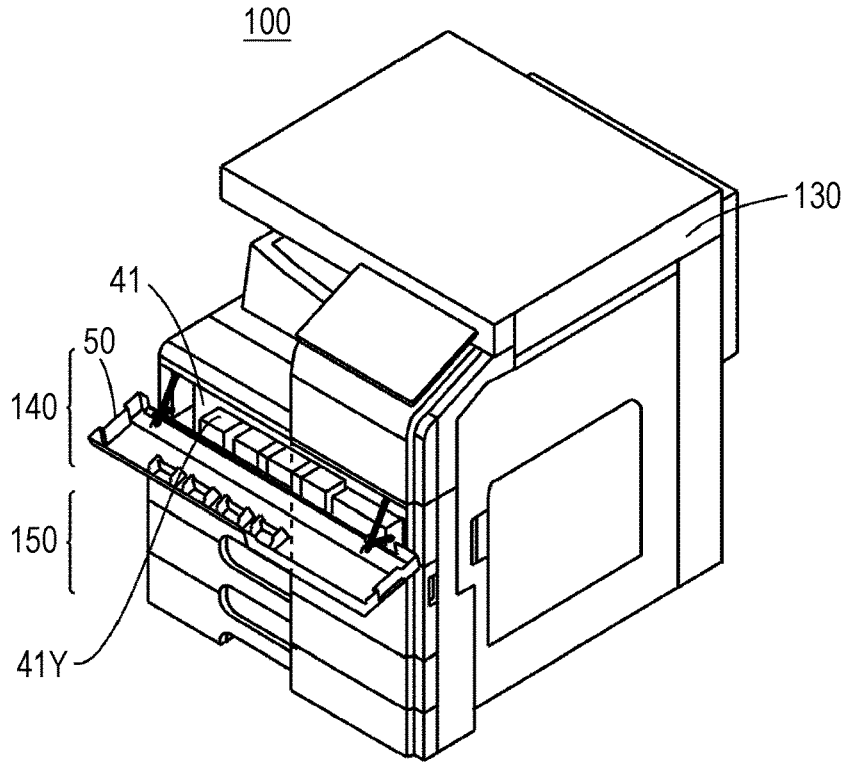
FIG. 3 is a second perspective view illustrating the external appearance of the MFP according to the embodiment of the present invention.

FIG. 3 is a second perspective view illustrating the external appearance of the MFP according to the embodiment of the present invention. Referring to FIG. 3, the MFP 100 is provided with a cover member 50 included in part of the main body case of the MFP 100, the cover member 50 exposing inside the main body of the MFP 100. FIG. 3 illustrates the MFP 100 in a fully open state of the cover member 50. The cover member 50 in the fully open state externally exposes the toner storage part 41 of the image former 140. The cover member 50 does not externally expose the image forming units 20Y, 20M, 20C, and 20K. With this arrangement, the image former 140 is set so as to perform an image forming operation in the fully open state of the cover member 50. Thus, even if the cover member 50 switches from a closed state to the fully open state during an image forming operation by the image former 140, the image former 140 continues the image forming operation without interruption. In addition, the toner storage part 41 is exposed in the fully open state of the cover member 50, and thus the user can replace at least one of the toner bottles 41Y, 41M, 41C, and 41K.

Figure 4:
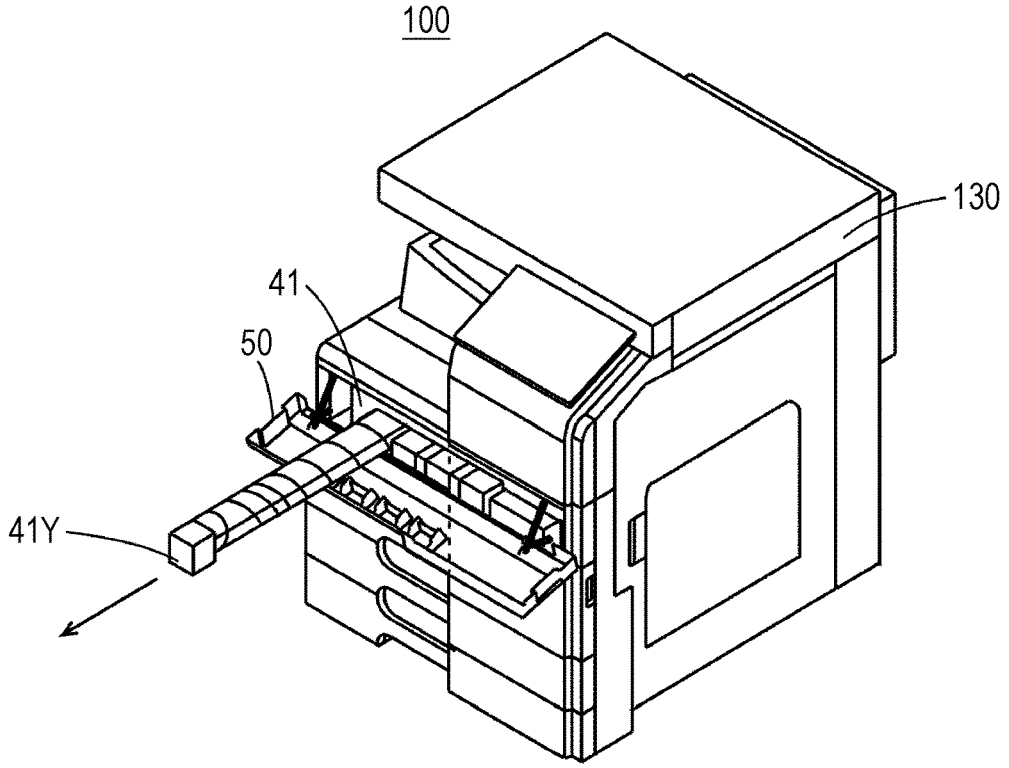
FIG. 4 is a view illustrating how a toner bottle is replaced at the MFP.

FIG. 4 is a view illustrating how a toner bottle is replaced at the MFP. Referring to FIG. 4, the toner bottle 41Y is pulled out from the toner storage part 41 of the MFP 100 in the rear face direction, so that the toner bottle 41Y is detached from the MFP 100. Thereafter, a new toner bottle 41Y is pushed into the toner storage part 41 of the MFP 100 in the front face direction, so that the new toner bottle 41Y is attached to the MFP 100. The rear face direction is a horizontal direction from the rear face to the front face. The front face direction is a horizontal direction from the front face to the rear face.

Figure 5:
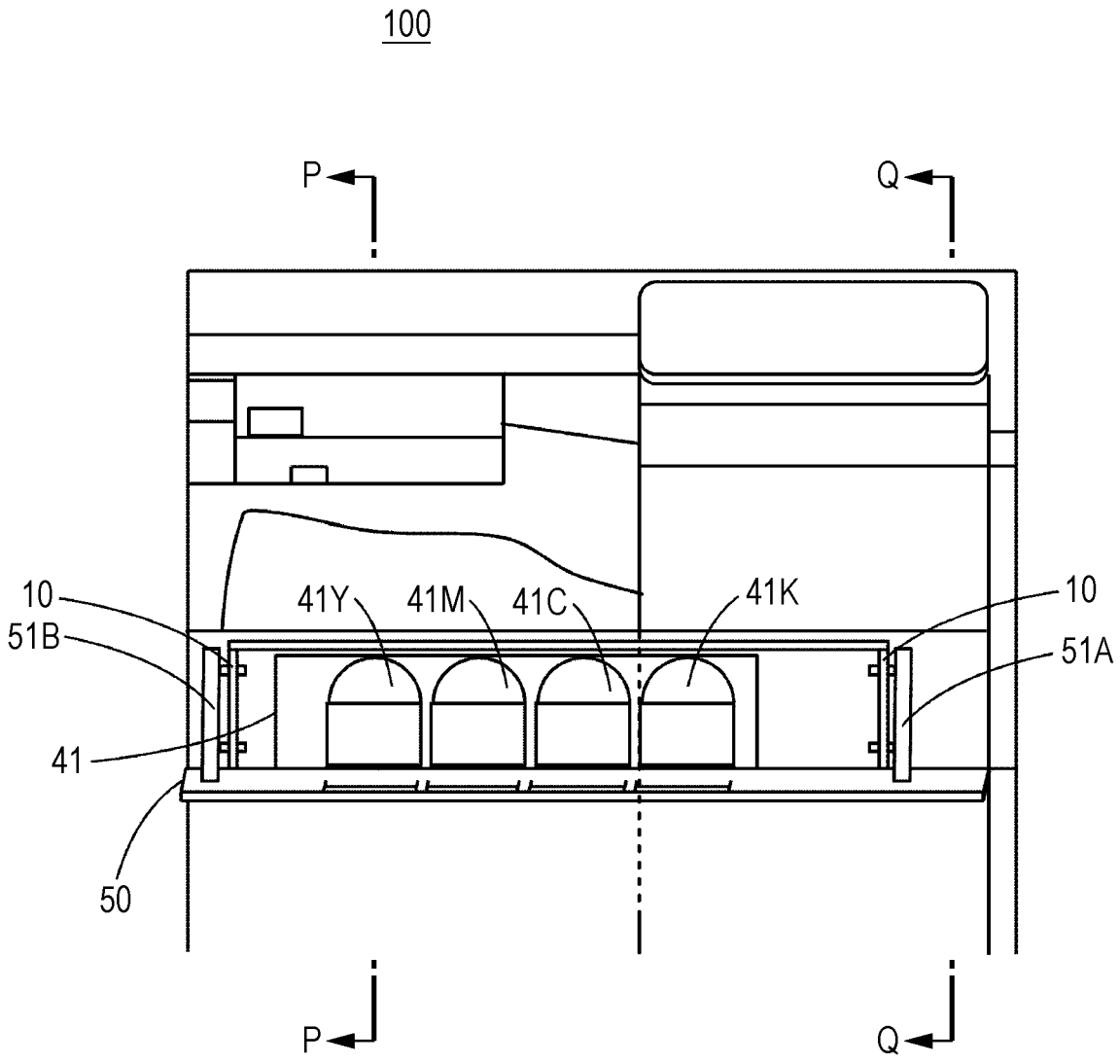
FIG. 5 is a front view of the MFP.
Figure 6:
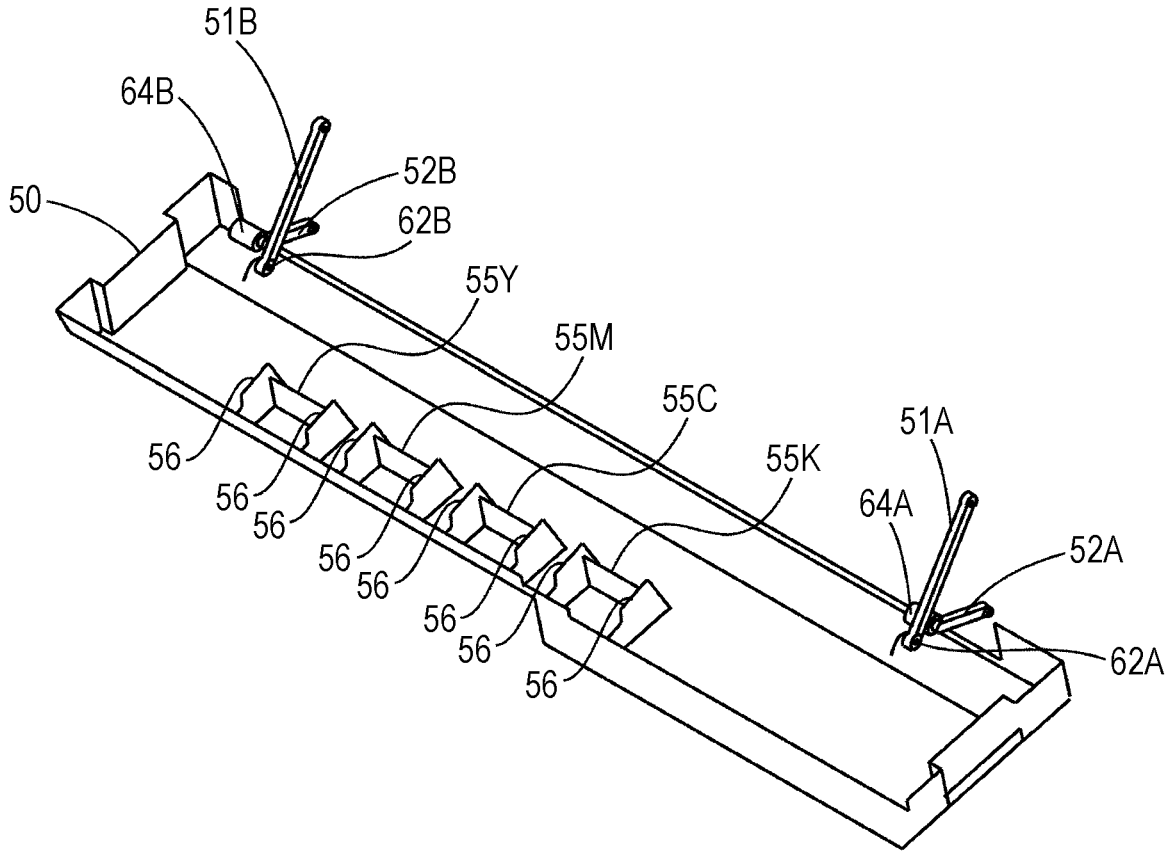
FIG. 6 is a perspective view of a cover member as viewed from the back face side.

FIG. 5 is a front view of the MFP. FIG. 6 is a perspective view of the cover member as viewed from the back face side. FIG. 5 illustrates the cover member 50 in an open state. Referring to FIGS. 5 and 6, the cover member 50 is coupled to a main body frame 10 by a first turn support member 51A and a second turn support member 52A, near the right end of the cover member 50. Further, the cover member 50 is coupled to the main body frame 10 by a first turn support member 51B and a second turn support member 52B, near the left end of the cover member 50. The toner storage part 41 is exposed in the open state of the cover member 50.

The cover member 50 has four guide members 55Y, 55M, 55C, and 55K on the back face of the cover member 50. Each of the four guide members 55Y, 55M, 55C, and 55K is formed of a plate material vertically extending from the back face of the cover member 50, and has both ends supported by respective reinforcing members 56 vertically extending from the back face of the cover member 50. The cover member 50 has second shafts 62A and 62B horizontally extending from the back face of the cover member 50, and fourth shafts 64A and 64B horizontally extending from the back face of the cover member 50. The first turn support member 51A has one end turnably attached to the second shaft 62A, and the first turn support member 51B has one end turnably attached to the second shaft 62B. The second turn support member 52A has one end turnably attached to the fourth shaft 64A, and the second turn support member 52B has one end turnably attached to the fourth shaft 64B. The first turn support members 51A and 51B have the other ends, respectively. The other ends, respectively, are turnably attached to first shafts 61A and 61B horizontally extending from the main body frame 10. The second turn support members 52A and 52B have the other ends, respectively. The other ends, respectively, are turnably attached to third shafts 63A and 63B horizontally extending from the main body frame 10.

The first turn support member 51A and the second turn support member 52A is symmetrical to the first turn support member 51B and the second turn support member 52B in positional relationship with the main body frame 10 and the cover member 50. Hereinafter, as an example, described will be the positional relationship of the first turn support member 51A and the second turn support member 52A with the main body frame 10 and the cover member 50.

Figure 7:
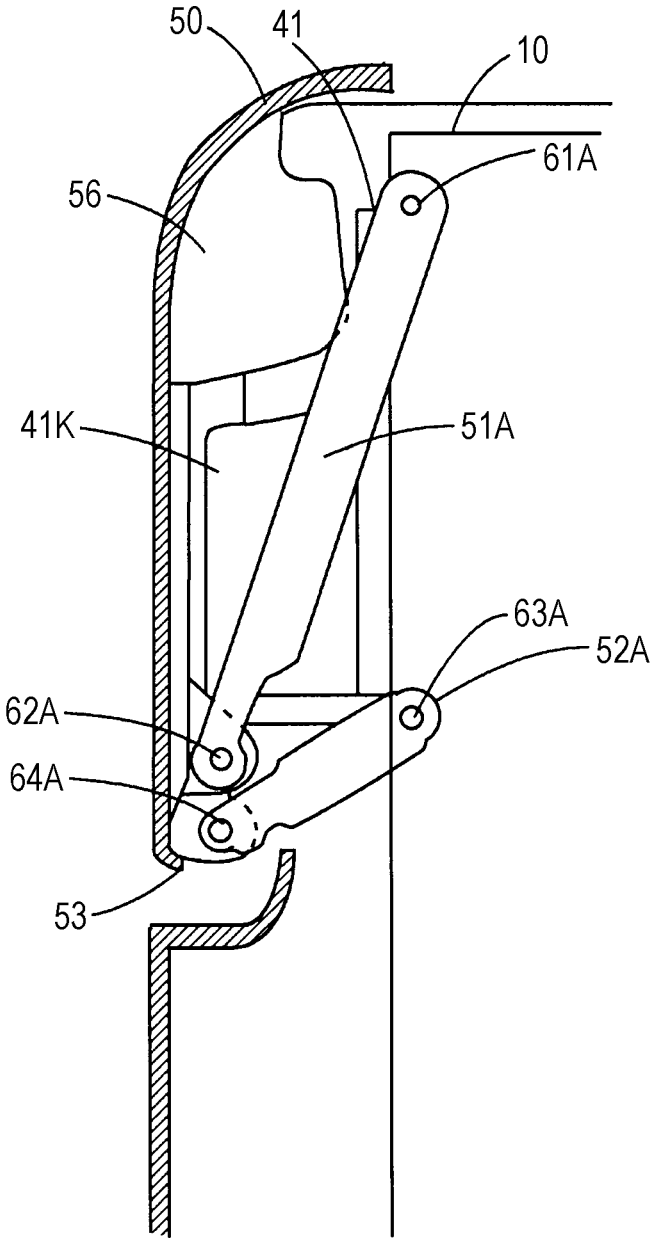
FIG. 7 is a first cross-sectional view of part of the MFP taken along line Q-Q in FIG. 5.
Figure 8:
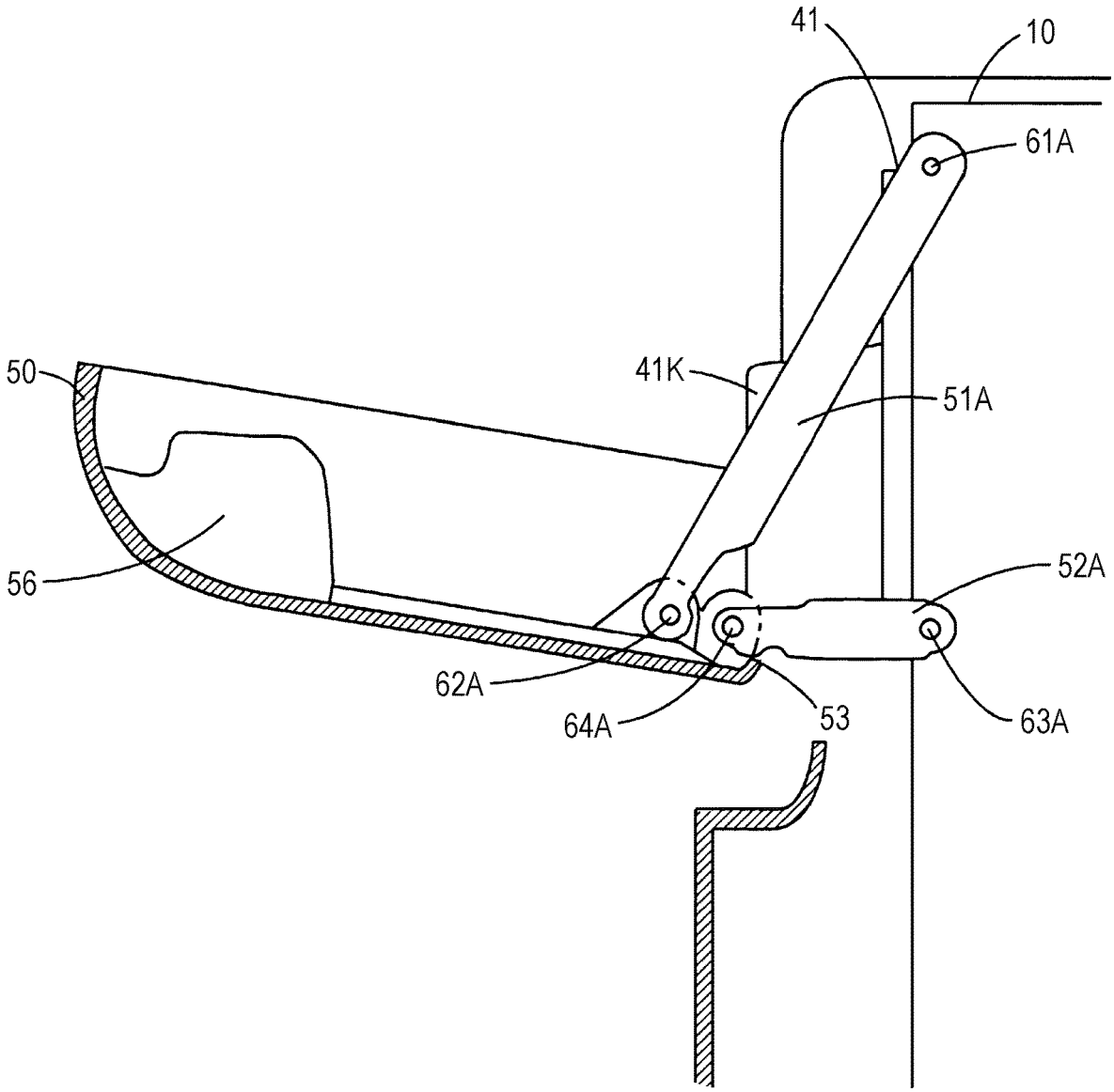
FIG. 8 is a second cross-sectional view of the part of the MFP taken along line Q-Q in FIG. 5.
Figure 9:
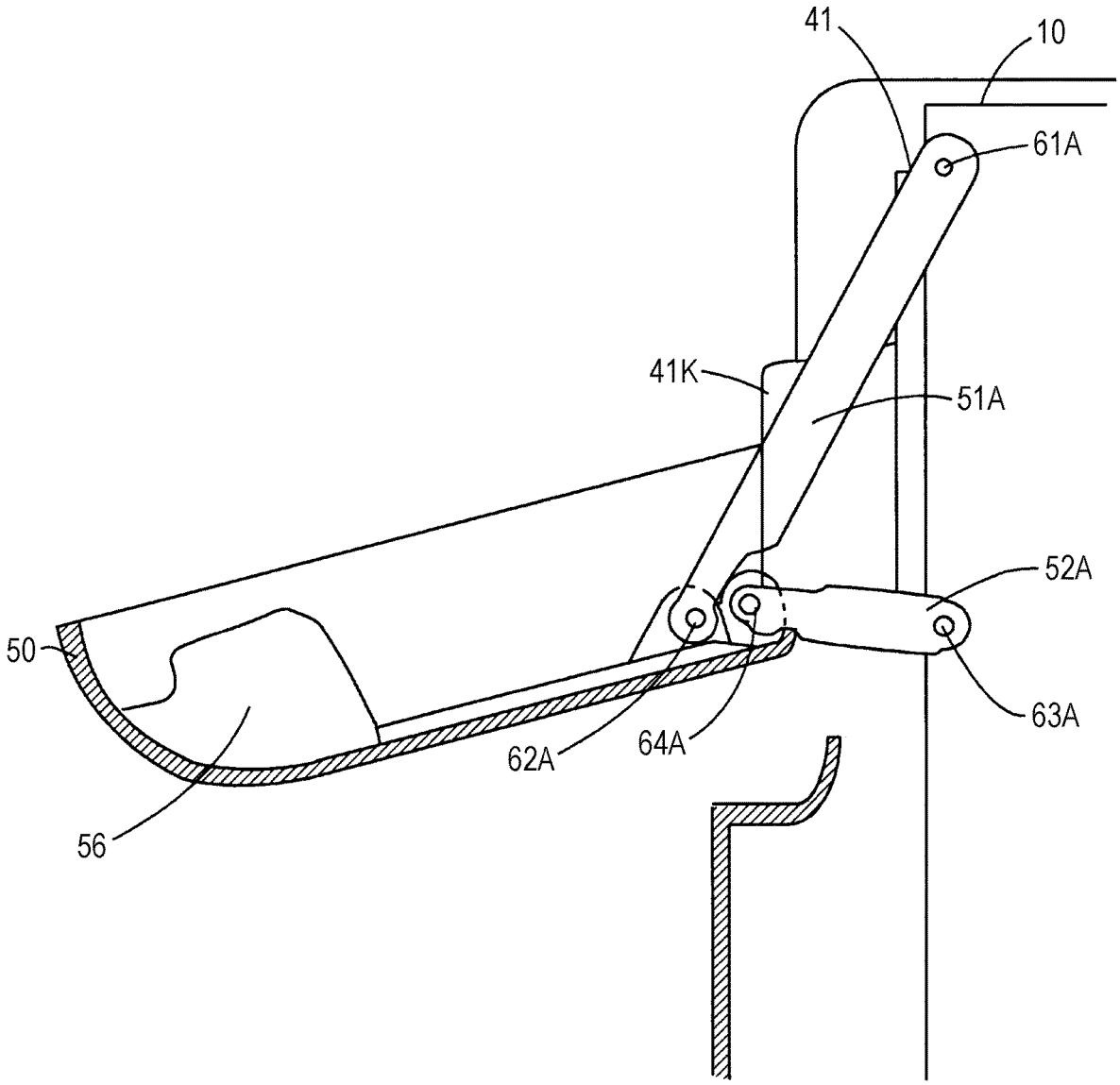
FIG. 9 is a third cross-sectional view of the part of the MFP taken along line Q-Q in FIG. 5.

FIGS. 7 to 9 are cross-sectional views of part of the MFP 100 taken along line Q-Q in FIG. 5. FIG. 7 illustrates the MFP 100 in the closed state of the cover member 50. FIG. 8 illustrates the MFP 100 in an intermediate state between the closed state and the fully open state of the cover member 50. FIG. 9 illustrates the MFP 100 in the fully open state of the cover member 50.

Referring to FIGS. 7 to 9, the main body frame 10 is provided with the first shaft 61A and the third shaft 63A. The first shaft 61A and the third shaft 63A horizontally extend from the main body frame 10. The first shaft 61A is disposed above the third shaft 63A. The third shaft 63A is disposed below the toner storage part 41.

The cover member 50 has the back face provided with the second shaft 62A and the fourth shaft 64A horizontally extending from the back face of the cover member 50. Specifically, the cover member 50 has a support wall vertically extending from the back face of the cover member 50, and the second shaft 62A and the fourth shaft 64A horizontally extend from the support wall.

The first turn support member 51A has the other end turnably attached to the first shaft 61A, and the one end turnably attached to the second shaft 62A. The second turn support member 52A has the other end turnably attached to the third shaft 63A, and the one end turnably attached to the fourth shaft 64A.

The distance L1 between the first shaft 61A and the second shaft 62A is longer than the sum of the distance L2 between the second shaft 62A and the fourth shaft 64A and the distance L3 between the third shaft 63A and the fourth shaft 64A. Thus, as illustrated in FIG. 7, the fourth shaft 64A is located below the straight line connecting the second shaft 62A and the third shaft 63A in the closed state of the cover member 50. However, as illustrated in FIG. 9, the fourth shaft 64A is movable above the straight line connecting the second shaft 62A and the third shaft 63A in the fully open state of the cover member 50. In the present embodiment, as illustrated in FIG. 7, the fourth shaft 64A is located below the second shaft 62A in the closed state of the cover member 50, and as illustrated in FIG. 9, the fourth shaft 64A is located above the second shaft 62A in the fully open state of the cover member 50. With this arrangement, the cover member 50 turns about the second shaft 62A by over 90 degrees during transition from the closed state to the fully open state.

Further, the second shaft 62A is located above the fourth shaft 64A in the closed state of the cover member 50. Thus, the second shaft 62A can be located below the fourth shaft 64A in the fully open state of the cover member 50. Furthermore, the third shaft 63A is provided below the toner storage part 41. Thus, the cover member 50 can be located below the toner storage part 41 in the fully open state of the cover member 50. This arrangement allows no interference of the cover member 50 with the toner bottles 41Y, 41M, 41C, and 41K that move horizontally.

Hereinafter, the state of the cover member will be described in detail. As illustrated in FIG. 7, the fourth shaft 64A and the second shaft 62A are provided at the cover member 50 such that the fourth shaft 64A is located below the second shaft 62A in the closed state of the cover member 50. The second shaft 62A is disposed closer to the front face (left side in FIG. 7) than the first shaft 61A is. The fourth shaft 64A is disposed closer to the front face than the third shaft 63A is.

Further, the fourth shaft 64A is located below the third shaft 63A in the closed state of the cover member 50. This arrangement allows the cover member 50 to be brought close to the main body frame 10 until the cover member 50 contacts the main body frame 10. Thus, in the closed state of the cover member 50, there can be prevented generation of a gap between the cover member 50 and the main body frame 10.

Note that the center of gravity of the cover member 50 is preferably determined such that the center of gravity of the cover member 50 in the closed state is located closer to the rear face (right side in FIG. 7) than the second shaft 62A is. This arrangement allows the cover member 50 to maintain the closed state while the cover member 50 is closed.

Further, the second shaft 62A is disposed closer to the front face than the first shaft 61A is. Thus, in the closed state of the cover member 50, the second shaft 62A to which the one end of the first turn support member 51A is attached is movable toward the front face. Similarly, the fourth shaft 64A is disposed closer to the front face than the third shaft 63A is. Thus, in the closed state of the cover member 50, the fourth shaft 64A to which the one end of the second turn support member 52A is attached is movable toward the front face. In other words, the first turn support member 51A is turnable clockwise in the figure about the first shaft 61A, and the second turn support member 52A is turnable clockwise in the figure about the third shaft 63A.

FIG. 8 illustrates the MFP 100 in a state where the fourth shaft 64A has the same height as the third shaft 63A, in other words, the second turn support member 52A is horizontal. In the intermediate state, a state where the second turn support member 52A is horizontal is referred to as the maximum spaced state. During from the closed state illustrated in FIG. 7 to the maximum spaced state illustrated in FIG. 8, the horizontal distance between the third shaft 63A and the fourth shaft 64A increases. During from the closed state to the maximum spaced state, the horizontal distance between the third shaft 63A and the fourth shaft 64A increases. Thus, a space for turning by the cover member 50 is generated between the main body frame 10 and the cover member 50. As a result, the cover member 50 is turnable with no interference of the cover member 50 with the main body frame 10. Note that before transition from the closed state to the maximum spaced state of the cover member 50, in a case where a space for turning by the cover member 50 is generated between the main body frame 10 and the cover member 50, the cover member 50 is turnable at the generation of the space.

During from the maximum spaced state illustrated in FIG. 8 to the fully open state illustrated in FIG. 9, the horizontal distance between the third shaft 63A and the fourth shaft 64A decreases. Thus, for the horizontal distance between the third shaft 63A and the fourth shaft 64A, the distance in the fully open state of the cover member 50 can be made equal to or shorter than the distance in the closed state of the cover member 50.

Further, as illustrated in FIG. 9, the second shaft 62A is located below the fourth shaft 64A in the fully open state of the cover member 50. Thus, the cover member 50 has turned about the second shaft 62A by over 90 degrees in the fully open state of the cover member 50. In other words, the cover member 50 has further turned below the second turn support member 52A in the fully open state of the cover member 50.

Further, in the fully open state of the cover member 50, the cover member 50 is not located in the horizontal space from the toner bottle 41K. Thus, in the present embodiment, the distance L1 between the first shaft 61A and the second shaft 62A is determined such that the second shaft 62A is located below the toner storage part 41 in the fully open state of the cover member 50. With this arrangement, the cover member 50 is not located in a horizontal space from the toner bottle 41K, and thus a space for horizontally moving the toner bottle 41K stored in the toner storage part 51 is secured.

In the present embodiment, the distance L1 between the first shaft 61A and the second shaft 62A is made longer than the vertical distance between the first shaft 61A and the third shaft 63A such that the second shaft 62A is located below the toner storage part 41 in the fully open state of the cover member 50. Note that if the cover member 50 is located below the toner storage part 41 in the fully open state of the cover member 50, the second shaft 62A does not need to be located below the toner storage part 41 in the fully open state of the cover member 50.

Figure 10:
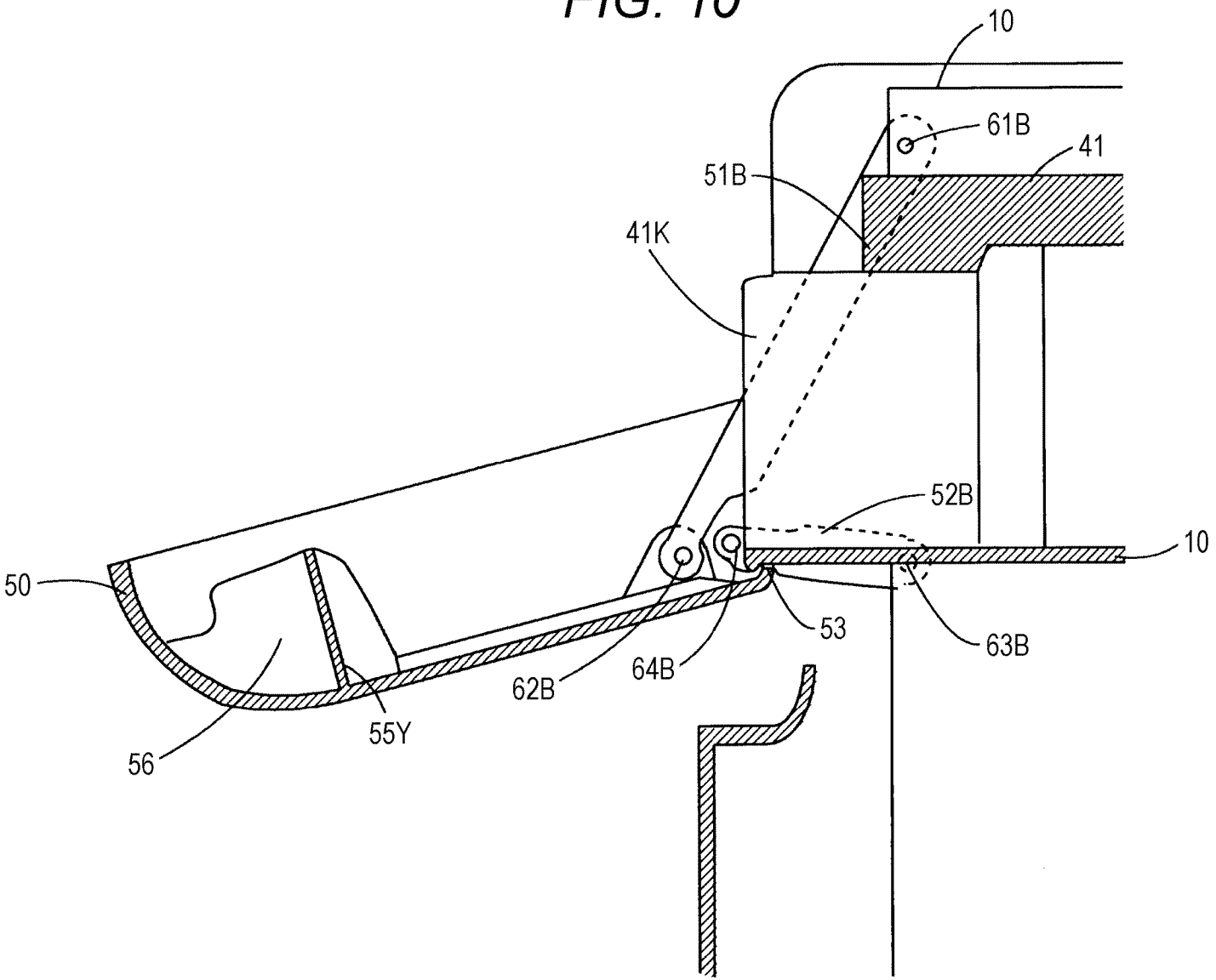
FIG. 10 is a first cross-sectional view of part of the MFP taken along line P-P in FIG. 5.

FIG. 10 is a first cross-sectional view of part of the MFP taken along line P-P in FIG. 5. FIG. 10 illustrates the MFP 100 in the fully open state of the cover member 50. Referring to FIG. 10, the fourth shaft 64B is located above the third shaft 63B. Thus, the cover member 50 has turned about the fourth shaft 64B by over 90 degrees. In the fully open state of the cover member 50, the end 53 of the cover member 50 is in contact with a lower portion of the main body frame 10. The end 53 of the cover member 50 is in contact with the main body frame 10, and thus turning of the cover member 50 is restricted. Further, part of the cover member 50 overlaps the lower portion of the main body frame 10. Thus, no gap is generated between the main body frame 10 and the cover member 50. With this arrangement, toner dropped from the toner bottle 41Y can be prevented from dropping below the cover member 50.

Figure 11:
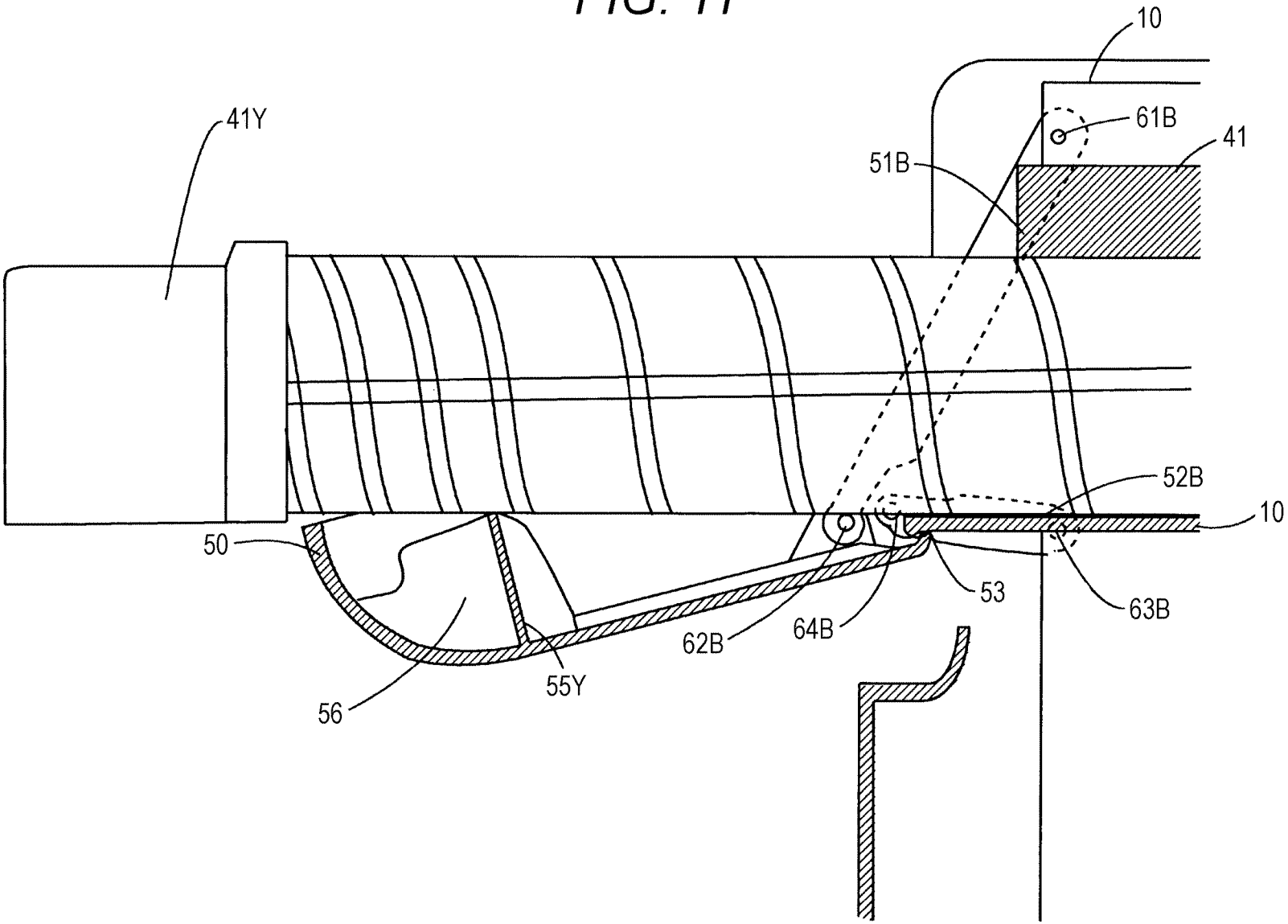
FIG. 11 is a second cross-sectional view of the part of the MFP taken along line P-P in FIG. 5.

FIG. 11 is a second cross-sectional view of the part of the MFP taken along line P-P in FIG. 5. FIG. 11 illustrates a halfway state where the toner bottle 41Y is attached to the main body frame 10 in the cross-sectional view of FIG. 10. The end 53 of the cover member 50 is in contact with the lower portion of the main body frame 10. Thus, the position of the cover member 50 can be determined such that turning by the cover member 50 is prevented with the toner bottle 41Y placed on the cover member 50. Further, the cover member 50 has the end 53 supported by the main body frame 10, and the second shaft 62B supported by the main body frame 10 via the first turn support member 51B. Therefore, a predetermined distance is provided between the end 53 and the second shaft 62B. Although an external force is applied to the cover member 50, the external force applied to the cover member 50 can be dispersed to the end 53 and the second shaft 62B.

The position of the cover member 50 in the fully open state is determined such that the upper end of the guide member 55Y is lower than the lower end of the toner storage part 41. The toner bottle 41Y is positioned at two locations of the guide member 55Y and the main body frame 10. With this arrangement, the positioning of the toner bottle 41Y determines a direction in which the toner bottle 41Y is inserted into the main body frame 10 or a direction in which the toner bottle 41Y is pulled out from the main body frame 10. As a result, the user can easily perform operation of attaching the toner bottle 41Y to or detaching the toner bottle 41Y from the main body frame 10.

A force in the gravitational direction is applied to the guide member 55Y from the toner bottle 41Y. This force is dispersed to the end 53 and the second shaft 62B of the cover member 50. In this case, the second shaft 62B serves as the fulcrum, the guide member 55Y serves as the effort, and the end 53 serves as the load. Therefore, in order to reduce a force applied to the second shaft 62B, as viewed from the left side-face direction, it is preferable to make, as small as possible, the ratio of the distance between the second shaft 62B and the end 53 to the distance between the guide member 55Y and the second shaft 62B. In other words, as viewed from the left side-face direction, it is preferable to locate the second shaft 62B as close to the guide member 55Y as possible.

In order to increase the distance between the cover member 50 and the main body frame 10 in the intermediate state of the cover member 50, it is sufficient if the distance L3 between the third shaft 63A and the fourth shaft 64A is lengthened. Further, the angle of the second turn support member 52A turnably about the third shaft 63A is determined by: the distance L1 between the first shaft 61A and the second shaft 62A; the distance L2 between the second shaft 62A and the fourth shaft 64A; the distance L3 between the third shaft 63A and the fourth shaft 64A; and the distance L4 between the first shaft 61A and the third shaft 63A. Thus, the distance L3 between the third shaft 63A and the fourth shaft 64A is determined such that a turn angle at which the fourth shaft 64A is movable above and below the third shaft 63A can be maintained. The distance L3 between the third shaft 63A and the fourth shaft 64A may be the distance L2 between the second shaft 62A and the fourth shaft 64A or longer, or may be shorter than the distance L2 between the second shaft 62A and the fourth shaft 64A.

Note that the MFP 100 has been described as an example of an image forming apparatus in the present embodiment; however, the image forming apparatus may be a copying machine, a laser beam printer, a facsimile machine, or the like.

Although embodiments of the present invention have been described and illustrated in detail, the disclosed embodiments are made for purposes of illustration and example only and not limitation. The scope of the present invention should be interpreted by terms of the appended claims, rather than the description above, and it is intended that the scope of the present invention includes any modifications within the scope and meaning equivalent to the scope of the appended claims.

What is claimed is:

1. An image forming apparatus comprising:

a cover member that covers part of a main body frame;

a first turn support member having: one end turnably supported by a first shaft provided at the main body frame, the first shaft extending horizontally; and another end turnably supported by a second shaft provided at the cover member, the second shaft extending horizontally; and a second turn support member having: one end turnably supported by a third shaft provided below the first shaft of the main body frame, the third shaft extending horizontally; and another end turnably supported by a fourth shaft provided at the cover member, the fourth shaft extending horizontally, wherein in a closed state where the cover member covers the main body frame, the fourth shaft is located below the third shaft, and in a fully open state of the cover member, the fourth shaft is located above the third shaft.

2. The image forming apparatus according to claim 1, wherein in the fully open state, the cover member is in contact with the main body frame.

3. The image forming apparatus according to claim 1, wherein the main body frame includes a toner storage part that stores a toner bottle that contains toner, and the third shaft is provided below the toner storage part.

4. The image forming apparatus according to claim 3, wherein the toner bottle is attached to or detached from the toner storage part due to horizontal movement of the toner bottle, and the cover member has a guide member that guides the attachment or detachment of the toner bottle.

5. The image forming apparatus according to claim 3, wherein a distance between the first shaft and the second shaft is longer than a sum of a distance between the third shaft and the fourth shaft and a distance between the fourth shaft and the second shaft, and the second shaft and the fourth shaft are provided at the cover member such that the second shaft is located above the fourth shaft in the closed state of the cover member.

6. The image forming apparatus according to claim 1, wherein a distance between the first shaft and the second shaft is longer than a sum of a distance between the third shaft and the fourth shaft and a distance between the fourth shaft and the second shaft.

7. The image forming apparatus according to claim 1, wherein a distance between the first shaft and the second shaft is longer than a vertical distance between the first shaft and the third shaft.

* * * * *